US006592960B1

(12) United States Patent
Suzuki et al.

(10) Patent No.: US 6,592,960 B1
(45) Date of Patent: Jul. 15, 2003

(54) BULKY NON-WOVEN FABRIC AND METHOD FOR MANUFACTURING THE SAME

(75) Inventors: Migaku Suzuki, Kamakura (JP); Shingo Mori, Tokyo (JP)

(73) Assignee: Japan Absorbent Technology, Tokyo (JP)

( * ) Notice: Subject to any disclaimer, the term of this patent is extended or adjusted under 35 U.S.C. 154(b) by 0 days.

(21) Appl. No.: 09/564,863

(22) Filed: May 4, 2000

(30) Foreign Application Priority Data

May 7, 1999 (JP) ..... 11-126512

(51) Int. Cl.[7] ..... B29C 59/00; B29C 59/02; B29C 59/04; D06C 11/00; B32B 33/00

(52) U.S. Cl. ..... 428/91; 428/92; 442/361; 442/382; 442/387; 442/384; 442/408; 442/415; 264/164; 264/239; 264/284; 264/293; 26/2 R

(58) Field of Search ..... 428/91, 92; 442/382, 442/394, 399, 361, 387, 384, 408, 415; 264/164, 167, 175, 239, 241, 243, 284, 293, 280; 26/2 R

(56) References Cited

U.S. PATENT DOCUMENTS

| | | | | | |
|---|---|---|---|---|---|
| 3,655,497 | A | * | 4/1972 | Forrest | 156/245 |
| 3,668,054 | A | | 6/1972 | Stumpf | |
| 3,696,183 | A | * | 10/1972 | Steel et al. | 264/164 |
| 3,701,621 | A | * | 10/1972 | Berglund et al. | 264/119 |
| 3,708,565 | A | * | 1/1973 | Seifert | 156/72 |
| 3,870,778 | A | * | 3/1975 | Steel | 156/230 |
| 3,976,820 | A | * | 8/1976 | Giovanelli et al. | 156/72 |
| 3,983,278 | A | * | 9/1976 | Wardle | 264/164 |
| 3,987,228 | A | * | 10/1976 | Hemming | 264/164 |
| 4,007,308 | A | * | 2/1977 | Hemming | 264/164 |
| 4,044,183 | A | * | 8/1977 | Forrest | 156/153 |
| 4,065,245 | A | * | 12/1977 | Brendel et al. | 156/72 |
| 4,076,874 | A | * | 2/1978 | Giovanelli et al. | 156/72 |
| 4,124,428 | A | * | 11/1978 | Forrest | 156/243 |
| 4,183,889 | A | * | 1/1980 | Brendel | 264/134 |
| 4,189,336 | A | * | 2/1980 | Hutflesz | 156/72 |
| 4,251,580 | A | * | 2/1981 | Angood et al. | 428/212 |
| 4,328,058 | A | * | 5/1982 | Lauchenauer | 156/254 |
| 4,347,931 | A | * | 9/1982 | Ginger et al. | 15/227 |
| 4,377,544 | A | * | 3/1983 | Rasmussen | 264/139 |
| 4,421,812 | A | | 12/1983 | Plant | |
| 4,451,419 | A | * | 5/1984 | Bye et al. | 264/164 |
| 4,810,556 | A | | 3/1989 | Kobayashi et al. | |

FOREIGN PATENT DOCUMENTS

| | | | |
|---|---|---|---|
| EP | 0334574 A2 | * | 9/1989 |
| JP | 56015322 A | * | 2/1981 |
| JP | 57-161151 | | 10/1982 |
| JP | 11-12920 | | 1/1999 |
| JP | 11-347062 | | 12/1999 |
| WO | WO 91/01211 | * | 2/1991 |
| WO | 99/20821 | | 4/1999 |
| WO | 99/22619 | | 5/1999 |
| WO | 99/23290 | | 5/1999 |
| WO | 99/25924 | | 5/1999 |

* cited by examiner

*Primary Examiner*—Cheryl A. Juska
(74) *Attorney, Agent, or Firm*—Kanesaka & Takeuchi

(57) ABSTRACT

A method of manufacturing a non-woven fabric which is bulky caused by fiber-raised construction on the surface of a non-woven fabric includes adhering a non-woven web with its surface layer portion containing an easy-to-heat-melt component showing a property to be adhesive as heated to a smooth surface heated at the temperature for the easy-to-heat-melt component to show a property to be adhesive with the surface layer portion in contact with the smooth surface, and then raising the fibers of the non-woven web by peeling the non-woven fabric like web off the smooth surface so that a fiber-raised bulky state is generated, whereby a fiber-raised bulky structure is formed on the surface of the non-woven fabric.

18 Claims, 11 Drawing Sheets

EXAMLES OF AFL PROCESS COMBINED WITH HOT-MELT SURFACE TREATMENT

APPLICATION EXAMPLE OF SMS NON-WAVON FABRIC

APPLICATION EXAMPLE OF DUAL LAYER SPUN LACE WEB

Figure 1:
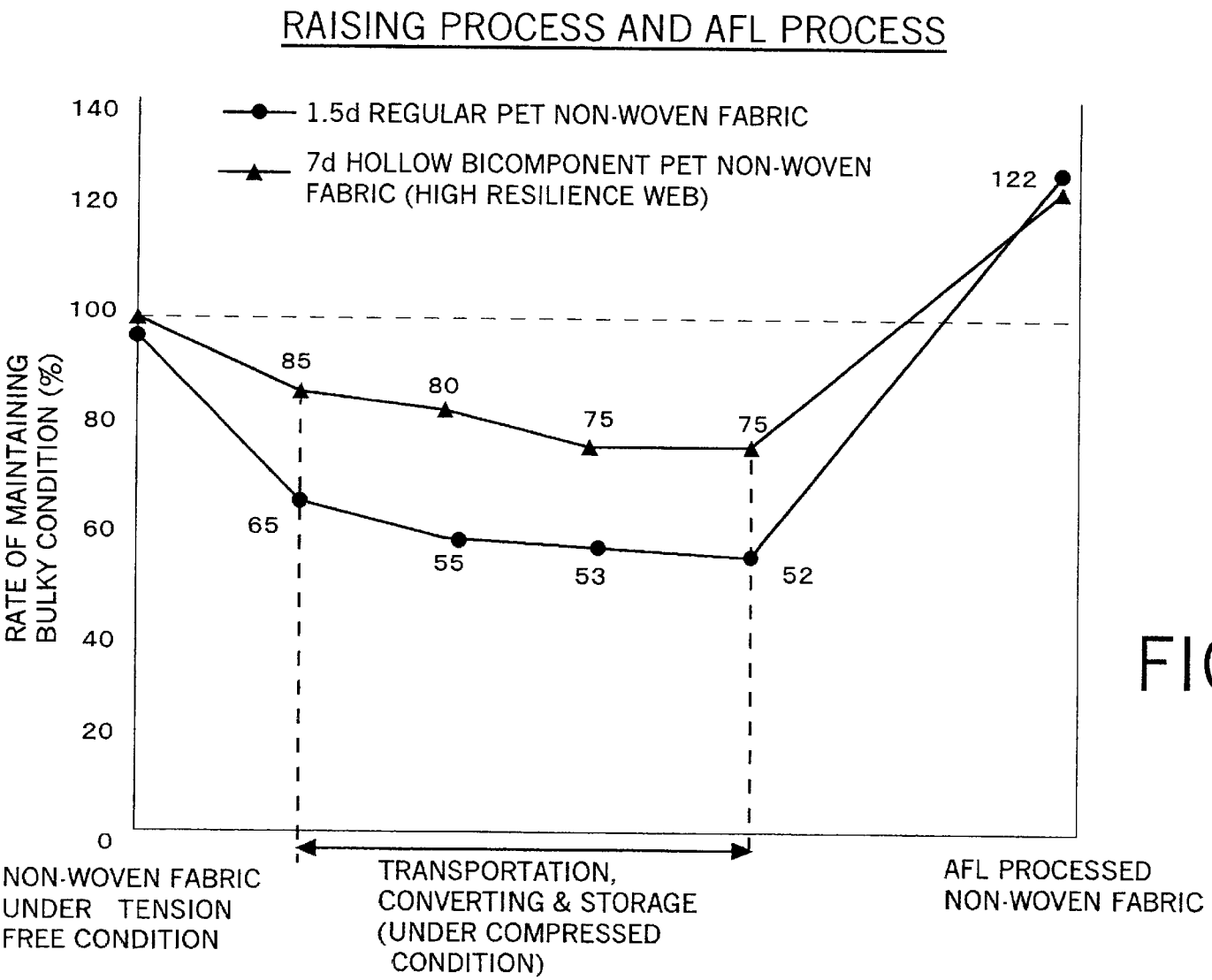

COMPRESSTION PROCESS FOR NON-WOVEN FABRIC USING EASY-TO-HEAT-MELT FIBER AND AFL PROCESSING SYSTEM FOR COPMRESSION PROCESSED NON-WOVEN FABRIC

COMPRESSION PROCESSING FOR TWO-LAYERED AIR-THROUGH NON-WOVEN FABRIC

FLOW SHEET AND PROCESS DIAGRAM SHOWING AN EXAMPLE OF COMPRESSION PROCESSING AND AFL PROCESSING COMBINED WITH ABSORBENT PRODUCING PROCESS

BULKY NON-WOVEN FABRIC AND METHOD FOR MANUFACTURING THE SAME

BACKGROUND OF THE INVENTION

1. Field of the Invention

The present invention relates to a method of manufacturing effectively and economically bulky non-woven fabric having a fluffy structure realized by fiber-raising process carried out during the processing of a non-woven fabric of relatively thin and having a relatively low density. Also, the present invention relates to such bulky non-woven fabric and composite absorbent material to be obtained by said method and absorbent products such as baby and incontinent diapers, feminine hygiene products and medical care products to be made by utilizing such non-woven fabric and composite absorbent material.

2. Related art

Bulky non-woven fabric is used in such uses as filling material, impregnated substrate, foamed substrate and the like as cushioning materials and in addition in many applications such as the top sheet for an absorbent product and a transfer layer and acquisition layer to reinforce an absorbent material.

A variety of methods have been proposed based on various technologies as ways to obtain bulky non-woven fabric of various kind commercially. Such methods are generally classified into six categories as follows:

(1) A method of forming web by means of carded method utilizing so-called bulky fiber such as hollow fiber or hollow bicomponent fiber having coarse denier and high resilience;

(2) A method of imparting a bulky structure by means of forming web consisting potently crimpable and heat shrinkable fibers and heat treating such web so that it becomes crimped and heat shrunk;

(3) A method of imparting a three-dimensional structure by means of continuously folding web oriented in the direction of X-Y like a carded web so that the web is oriented in the direction of Z axis, of then laminating and heat setting the web;

(4) A method of forming a fiber-raised structure by means of physically abrading the surface of non-woven fabric or of transplant;

(5) A method of obtaining bulky tow-like material by means of opening compressed crimped tow in an air stream; and (6) A method of obtaining a foamed fibrous structure by means of combining a method of manufacturing foamed material such as polyurethane foam, polyethylene foam and cellulose foam with fiber web.

Many of these methods have already been proposed so far. These methods have in common the following two problems in handling such resultant bulky structure:

First, such a structure is bulky for its weight and as such is difficult to be made into a large package so that the cost of handling it in commercial or industrial scenes becomes high. In order to solve such problem, rather complicated operations are needed to wind up it as it is displaced like winding on a bobbin (which is called "spooling") or heap it as folded (which is called "festooning").

Second, the characteristic bulkiness of the structure achieved with effort may gradually be reduced as it is handled or further processed.

One of methods thought of in solving these two problems is bulking non-woven fabric in a line of its use when or immediately before it is used so that the resultant bulkiness can be utilized as it is achieved, which is generally called "in-line bulking".

A typical example of the in-line bulking as reported is that card web pressured and compressed in the shape of mat beforehand is fed continuously into a disposable diaper making machine so that the card web is opened and swollen to make cushion material for baby and incontinent disposable diapers. Alternatively, as reported, shrinkable non-woven fabric is fed as overfed continuously into a heat shrinking machine directly connected to a disposable diaper making machine to cause heat shrinkage corresponding to the amount of the overfeeding in the fabric to make it web material which is, as is made, used as acquisition layer in a baby disposable diaper. An important disadvantage of these solutions is that the equipment of realizing the solutions becomes necessarily complicated and at the same time the difference in speed between the bulking of non-woven fabric and the converting into a disposable diaper can hardly be made up for to synchronize the times.

SUMMARY OF THE INVENTION

The present invention has been completed through as the result of intensive research and study intended to overcome the above-mentioned disadvantages of the in-line bulking and to investigate how a compact and efficient process is realized to do so.

The present invention provides a method of bulking a non-woven fabric comprising the steps of:

adhering a non-woven web with its surface layer portion containing an easy-to-heat-melt component showing a property to be adhesive as heated to a smooth surface heated at the temperature for the easy-to-heat-melt component to show a property to be adhesive with said surface layer portion in contact with the smooth surface; and peeling the non-woven fabric like web off said smooth surface so that a fiber-raised bulky state is generated by fiber-raising the fibers of said non-woven web; whereby a fiber-raised bulky structure is formed on the surface of said non-woven fabric.

In an aspect of the present invention, the adhering step may include a compressively adhering step where the non-woven web is compressively adhered onto the heated smooth surface.

The heated smooth surface may be formed into a cylinder-like shape and in this case, the compressively adhering step is achieved by means of more than one press roll for compressively adhering the non-woven web onto the cylinder-shaped heated smooth surface.

The present invention may include a further step that the non-woven web is preheated by having it pass through a hot air zone before it is introduced into the compressively adhering step.

In addition, the present invention may be provided with an post treatment step where the non-woven web through the fiber-raising step is cooled down so that the already formed fiber-raised structure is fixed.

A further additional step may be a pressing step where the non-woven web is pressed in part to an extent not substantially impairing the fiber-raised structure by pressing a heated roll with projections provided on the fiber-raised surface formed on the non-woven web.

The present invention also provides a method of bulking a non-woven fabric comprising the steps of:

obtaining a non-woven web by providing on the surface of a non-woven fabric a surface layer portion containing an easy-to-heat-melt component exhibiting a property to become adhesive as heated;

obtaining a compressed non-woven fabric by reducing the thickness of the non-woven web by compressing it in the direction of the thickness;

contacting said resultant compressed non-woven fabric with the surface of a roll heated at the temperature for said hot melt adhesive to develop a property to adhere or at higher temperatures and peeling said compressed non-woven fabric off the surface of the roll so as to raise the fiber of said non-woven web; and stabilizing the fiber-raised bulky structure by subsequently cooling down the fiber-raised portion.

In the present invention, as non-woven web a compressed non-woven fabric can be used as obtained by having non-woven fabric in a dry state with its surface layer portion including an easy-to-heat-melt bicomponent fiber through a heated compression roll so that the thickness is reduced and then cooling it down.

Preferably, the non-woven web is that to be produced by a spun-laced method where a carded web of two layers composed of a surface layer portion mainly consisting of polyethylene terephthalate fiber and a back surface layer mainly consisting of cellulose fiber is formed, entangled integrally in a high pressure water stream and then dried to obtain the non-woven web.

Alternatively, the non-woven web may be such that with a spun bond of polyethylene terephthalate as the basis a mixed carded web of polyethylene/polyethylene terephthalate bicomponent fiber and cellulose fiber is entangled and combined in a high pressure water stream or that with cellulose fiber as the basis, a mixed carded web is entangled and combined in a high pressure water stream consisting of polyethylene/polyethylene terephthalate bicomponent fiber and polyethylene terephthalate fiber.

Another preferable non-woven web used in the present invention is three or four layer composite web consisting of a two-layered spun-bonded web mainly composed of polyethylene terephthalate fiber or polypropylene fiber and a one or two-layered melt-blown web disposed between the two layers of the two-layered spun-bonded web.

In the multi-layered composite web, so-called SMS, SMMS, it is preferable that the two layers of the two-layered spun-bonded web have different deniers, respectively, with the denier of the surface side (d1) being coarser than that of the backside (d2) and with the relation between the denier (d1) and the denier (d2) being $$d1/d2 \geqq 1.5.$$

More preferably, the two layers of the two-layered spun-bonded web have different apparent specific gravities with the apparent specific gravity of the surface side web (SG1) being higher than that of the backside web (SG2) and with the relation between the bulk specific gravity (SG2) and the bulk specific gravity (SG1) being $$SG2/SG1 \geqq 1.2.$$

As the fabric-like non-woven web, a spun-bonded or its laminated material whose main component is an easy-to-heat-melt bicomponent fiber can also be used.

In addition, the present invention provides a fiber-raised bulky non-woven fabric characterized in that a non-woven web with a surface layer portion existent on the surface containing an easy-to-heat-melt component having a property to become adhesive as heated is adhered to a smooth surface heated at the temperature at which said easy-to-heat-melt component exhibits a property to become adhesive with said surface layer portion in contact with said smooth surface and then peeled off said smooth surface to generate a fiber-raised bulky state whereby a fiber-raised bulky structure is formed on the surface of said non-woven web.

A preferable easy-to-heat-melt component is, for example, particle, suspension or emulsion of homo-polymer or copolymer of EVA, MA, MMA or PE or natural rubber or synthetic rubber latex.

The easy-to-heat-melt component showing adhesiveness as heated can be a hot melt adhesive.

The easy-to-heat-melt component can be a bicomponent fiber having a property to be easy to heat melt, and in the fiber-raising step a cooling step where the easy-to-heat-melt component is cooled down.

In case the easy-to-heat-melt component is a hot melt adhesive, the amount of added hot melt adhesive is preferably 0.5 to 10% by weight of the total weight of the non-woven web.

The thermal softening point of the hot melt adhesive is preferably at least 20° C. lower than the temperature at which the fiber constituting the surface layer of the non-woven fabric starts to melt.

Alternatively, the easy-to-heat-melt component preferably contains a bicomponent fiber consisting of an easy-to-heat-melt high polymer showing a property to be adhesive at the time when it softens and melts and of relatively thermally stable high polymer component.

The content of the bicomponent fiber is preferably 20 to 100% by weight of the total weight of the non-woven web. The bicomponent fiber may be made of a sheath and core structure having a less-easy-to-heat-melt as the sheath and a relatively thermally stable component as the core.

In a further aspect of the present invention, there is provided a method of manufacturing a composite absorbent body comprising the steps of adhering non-woven web with a surface layer portion existent on the surface containing an easy-to-heat-melt component having a property to become adhesive as heated to a smooth surface heated at the temperature at which said easy-to-heat-melt component exhibits a property to become adhesive with said surface layer portion in contact with said smooth surface;

peeling the non-woven web off said smooth surface to generate a fiber-raised bulky state so as to raise the fibers of said non-woven web; a step of forming non-woven web having a fiber-raised bulky structure on its surface;

applying a highly absorbent polymer in slurry to the fiber-raised bulky surface of the non-woven web obtained in the previous step used as a substrate to make a composite; and removing dispersion medium out of said slurry so that the highly absorbent polymer is fixed in the non-woven web.

According to another aspect of the present invention is provided an absorbent product wherein on the surface of non-woven web are provided a non-woven web having a fiber-raised bulky structure on its surface and an absorbent body, said non-woven web being obtained through a adhering step of adhering non-woven web with a surface layer portion existent on the surface containing an easy-to-heat-melt component having a property to become adhesive as heated to a smooth surface heated at the temperature at which said easy-to-heat-melt component exhibits a property to become adhesive with said surface layer portion in contact with said smooth surface and a fiber-raising step of then peeling the non-woven web off said smooth surface to generate a fiber-raised bulky state, and said fiber-raised bulky non-woven fabric being disposed with fiber-raised surface having a cushion property facing said absorbent body and its smooth backside functioning as a topsheet in contact with the body of a wearer.

In such absorbent product the fiber-raised bulky non-woven fabric has preferably such a porous structure on the smooth backside as permit liquid to physically permeate.

According to still another aspect of the present invention is provided an absorbent product wherein a substrate consisting of non-woven web having a fiber-raised bulky structure on its surface and an absorbent body consisting of a highly absorbent composite where the substrate and a particulate highly absorbent polymer are integrated, said non-woven web being obtained through a adhering step of adhering non-woven web with a surface layer portion existent on the surface containing an easy-to-heat-melt component having a property to become adhesive as heated to a smooth surface heated at the temperature at which said easy-to-heat-melt component exhibits a property to become adhesive with said surface layer portion in contact with said smooth surface and a fiber-raising step of then peeling the non-woven web off said smooth surface to generate a fiber-raised bulky state.

In this absorbent product, the highly absorbent composite body can be used as the backsheet as provided with water impermeability with the non-woven web containing the easy-to-heat-melt component being liquid impervious and water resistance and with the highly absorbent resin made in an integral composite with the fiber-raised surface of the non-woven web.

The present invention provides a method of manufacturing an absorbent product comprising the steps of:

adhering non-woven web with a surface layer portion existent on the surface containing an easy-to-heat-melt component having a property to become adhesive as heated to a smooth surface heated at the temperature at which said easy-to-heat-melt component exhibits a property to become adhesive with said surface layer portion in contact with said smooth surface, a fiber-raising step of then peeling the non-woven web off said smooth surface to generate a fiber-raised bulky state, and forming non-woven web having a fiber-raised bulky structure on its surface, and a step of incorporating the non-woven web obtained in the previous step into an absorbent product.

According to the present invention, since a non-woven web with a surface layer portion disposed on its surface containing an easy-to-heat-melt component having a property to be adhesive as heated is adhered to a smooth surface heated to a temperature at which the easy-to-heat-melt component becomes adhesive in contact with the surface layer portion, and peeled off the smooth surface so that a fiber-raised bulky state is generated, the non-woven web can be fed as being made bulky directly connected to a disposable diaper making machine so that the non-woven web as it is can be used as a component material of a diaper whereby the method of making a diaper can be simplified equipment-wise and process-wise and the speed of the diaper making line can be made higher.

In addition, bulky non-woven fabric to be obtained by the methods of the present invention can be advantageously used as topsheet for an absorbent article and as transfer and acquisition layers to reinforce an absorbent body in such a variety of uses as contain absorbent products like disposable baby and incontinent diapers, feminine hygiene articles and medical care products.

BRIEF DESCRIPTION OF THE INVENTION

Figure 2A:
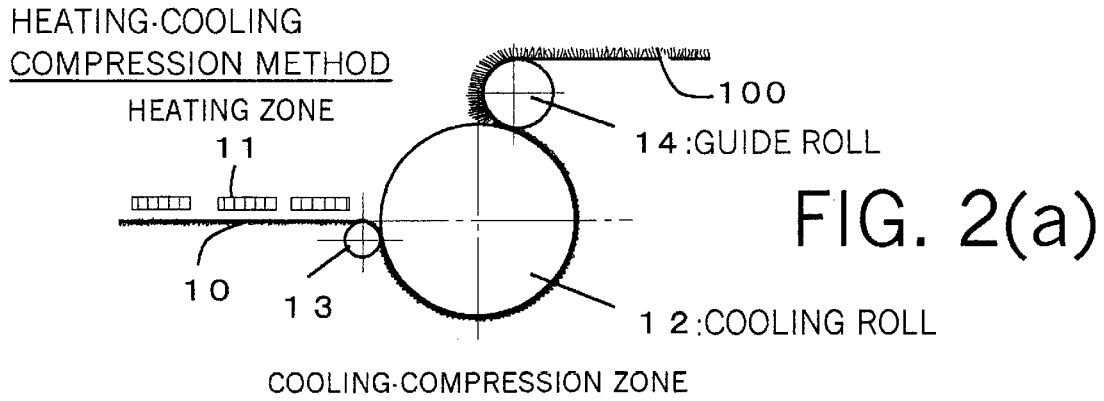
Figure 2B:
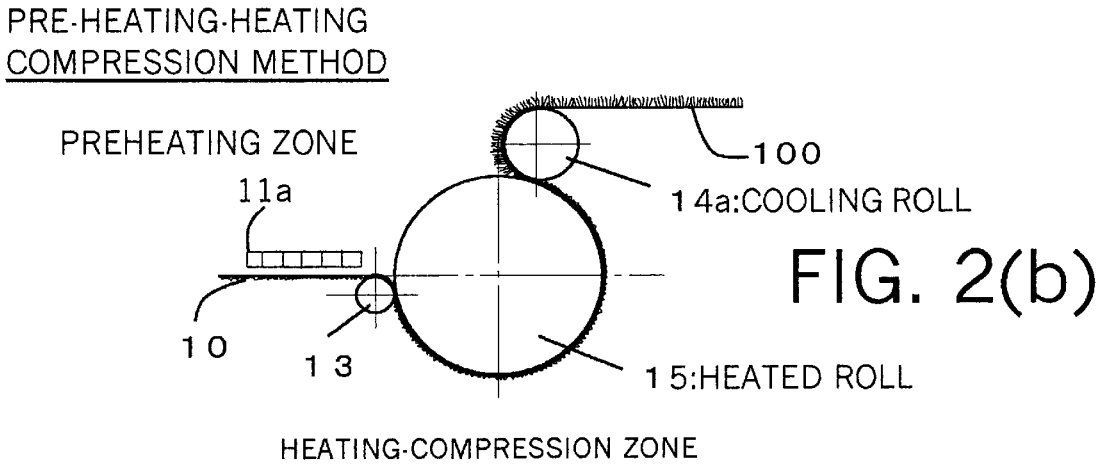
Figure 2C:
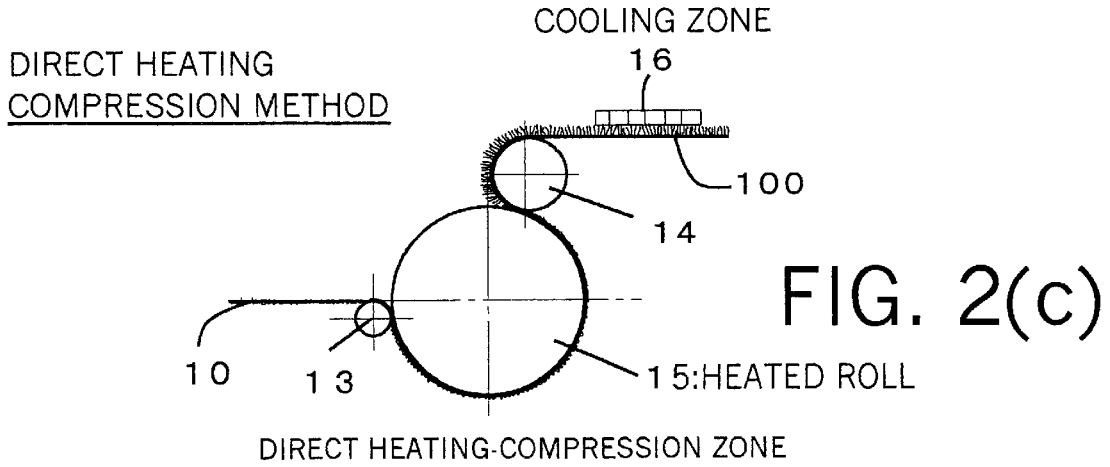
Figure 3:
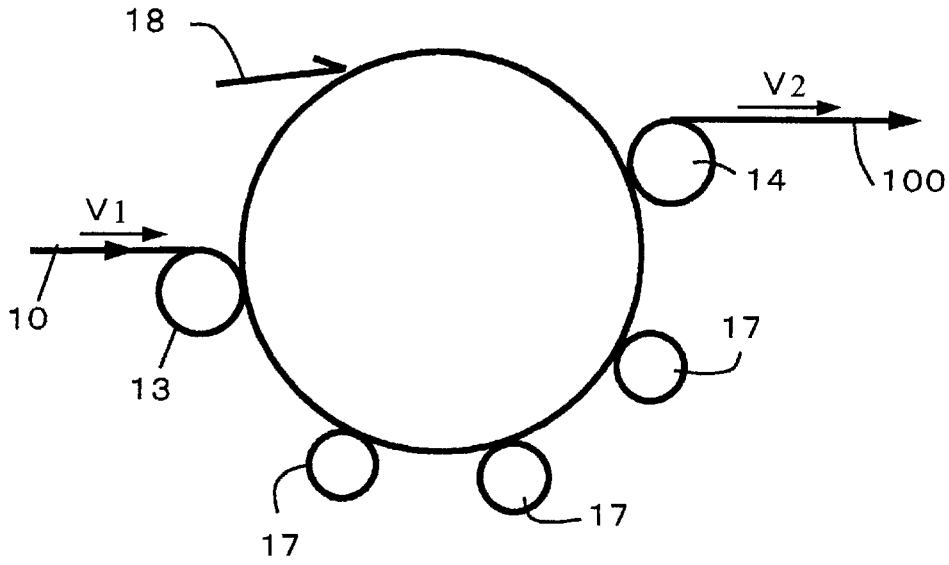
Figure 9A:
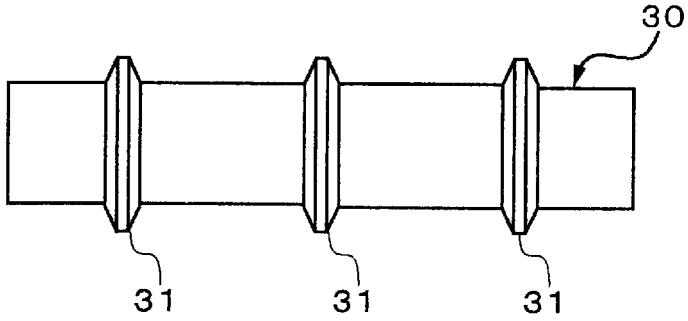
Figure 9B:
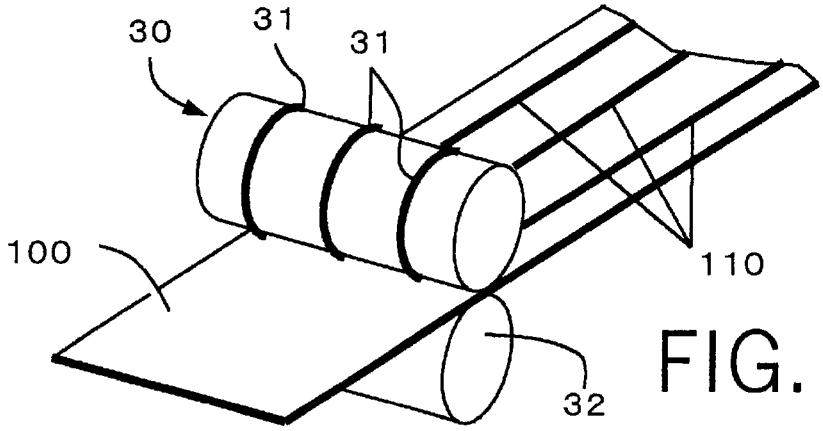
Figure 4A:
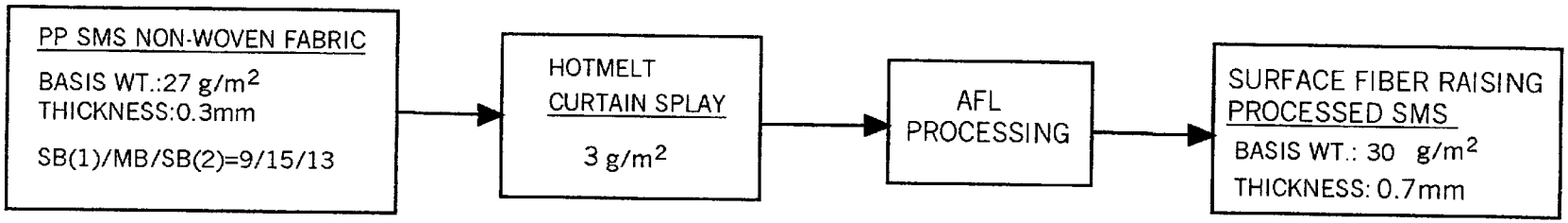
Figure 4B:
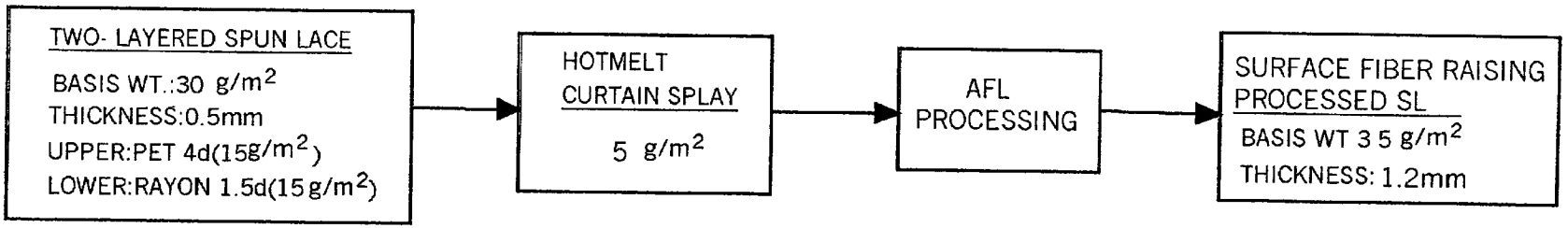
Figure 5:
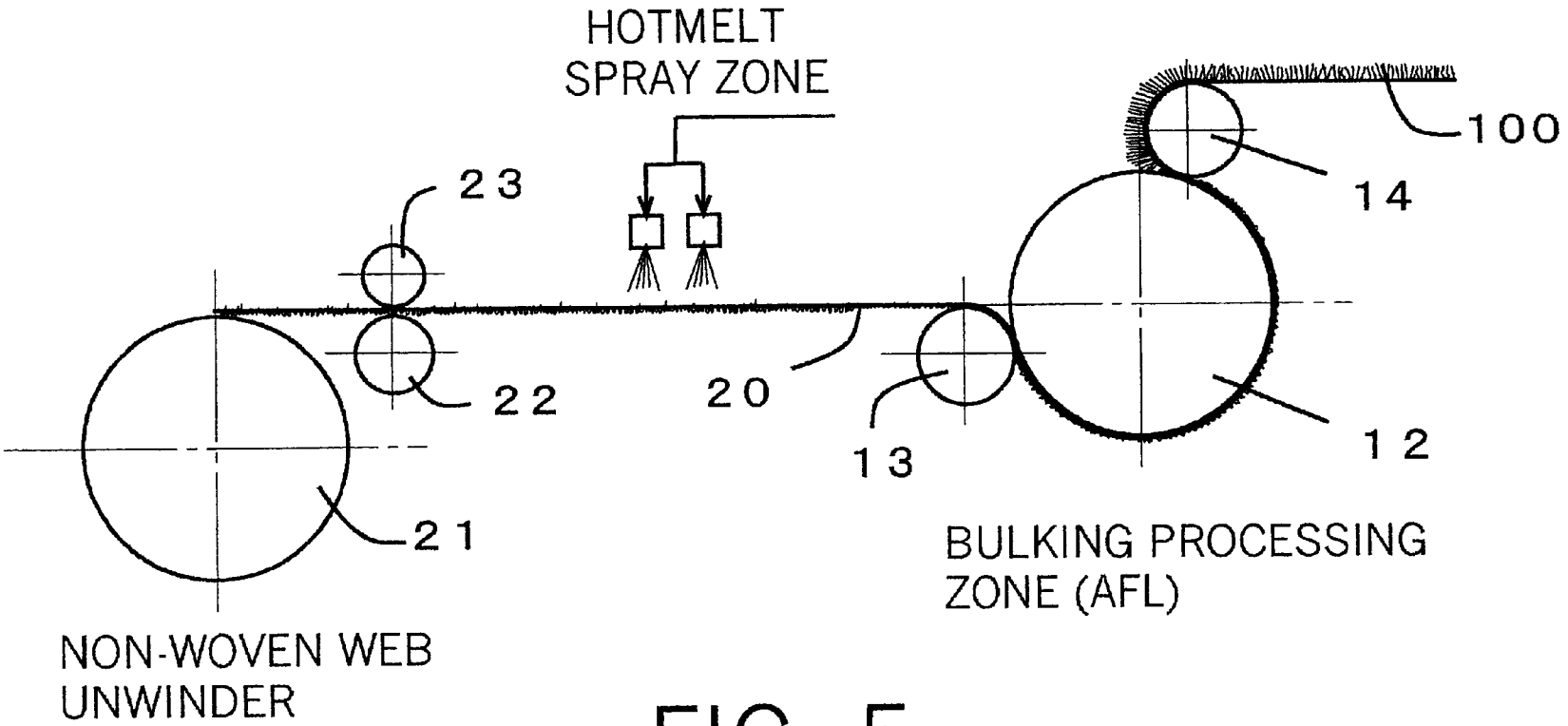
Figure 6A:
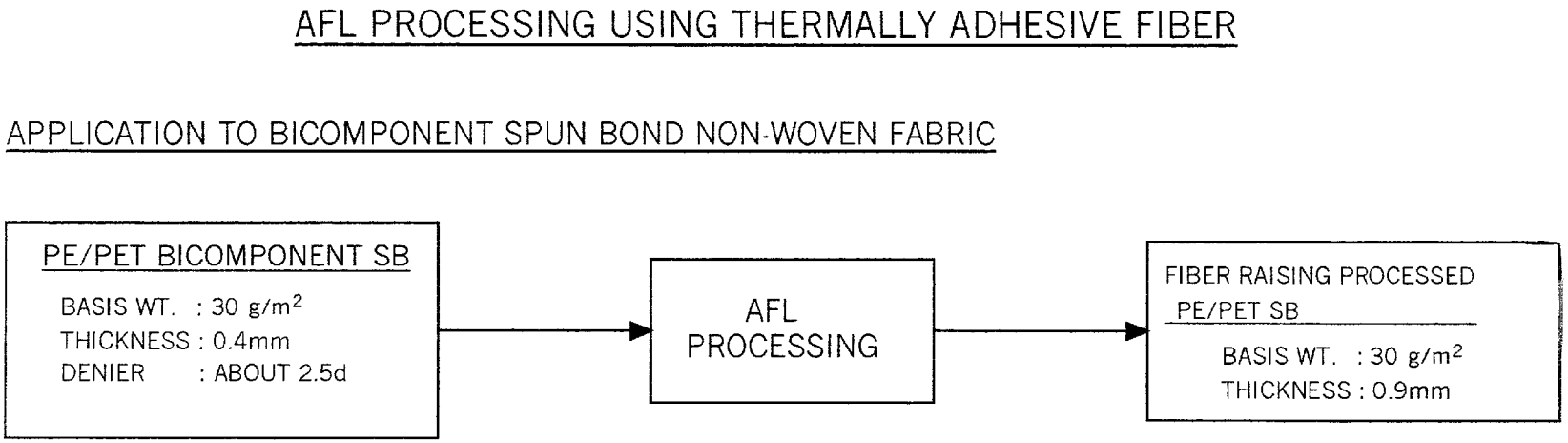
Figure 6B:
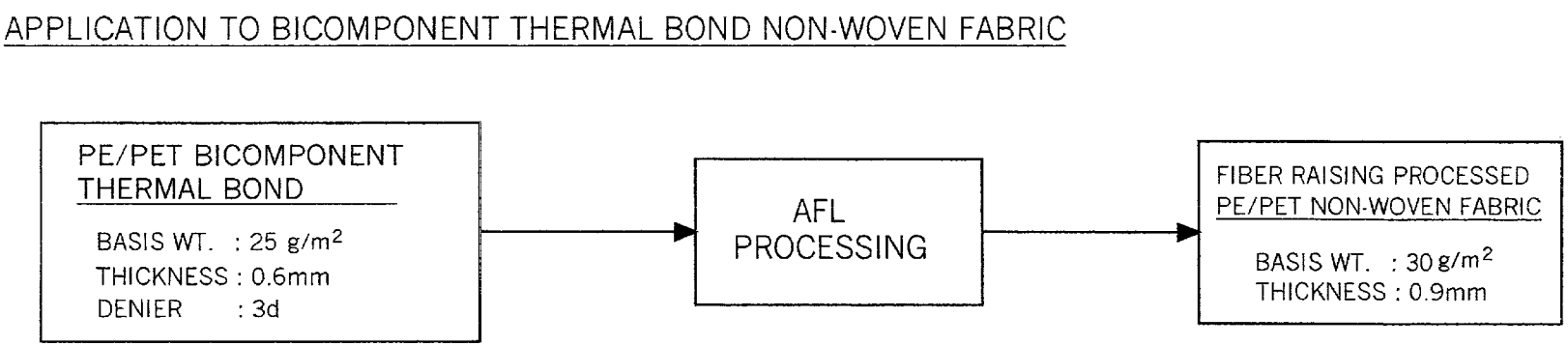
Figures 7A, 7B:
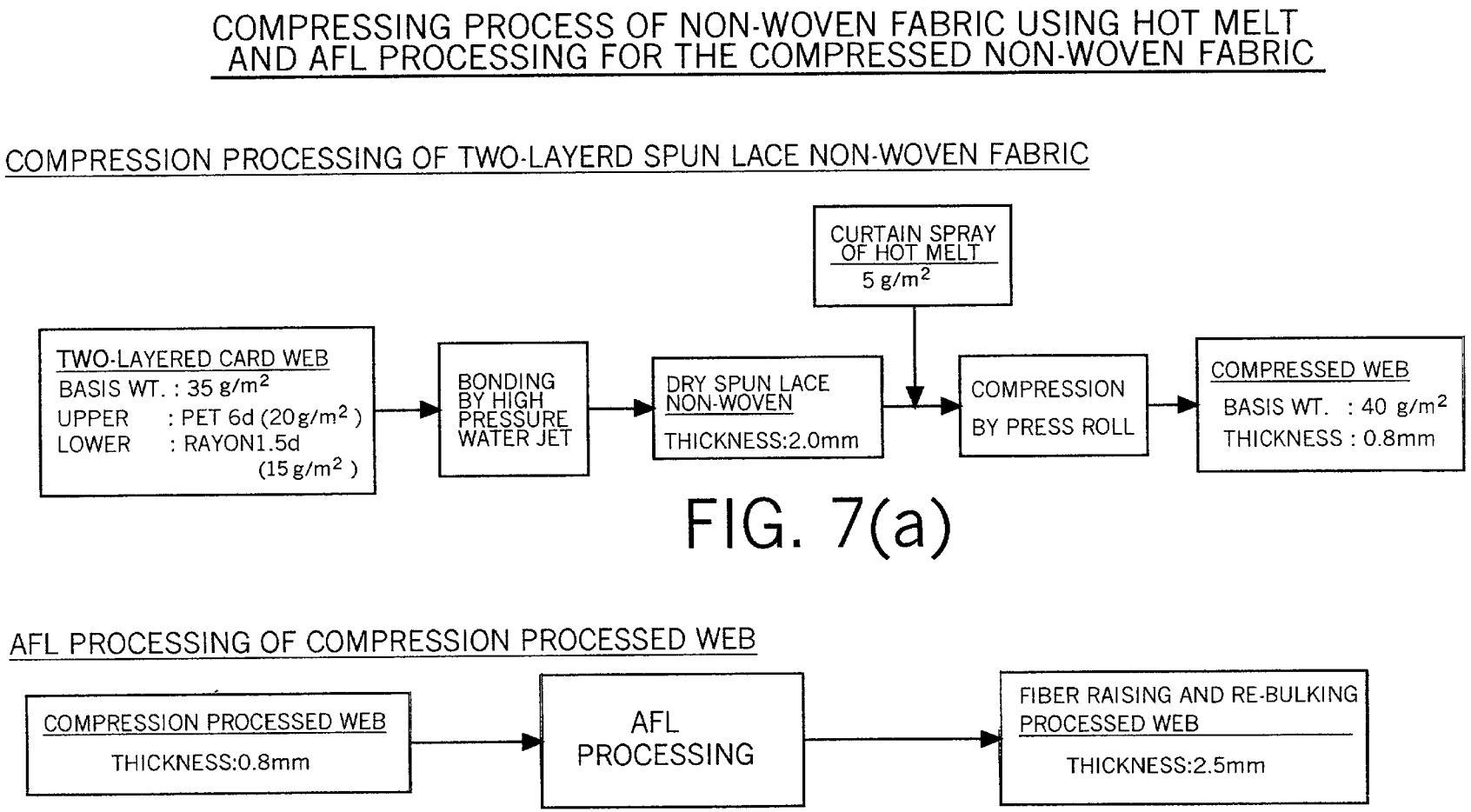
Figure 8A:
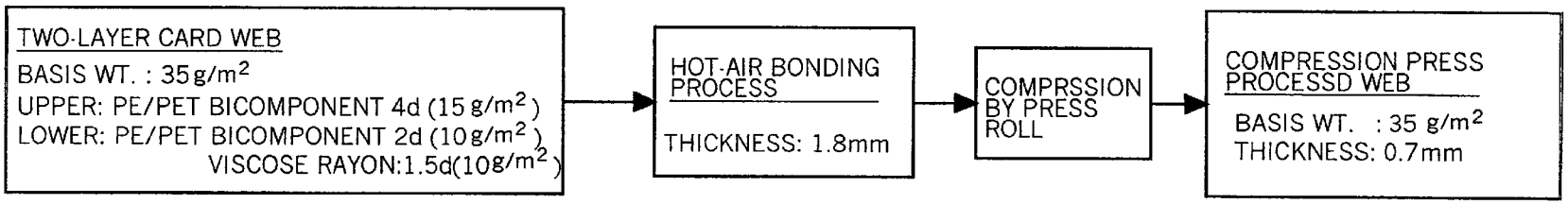
Figure 8B:
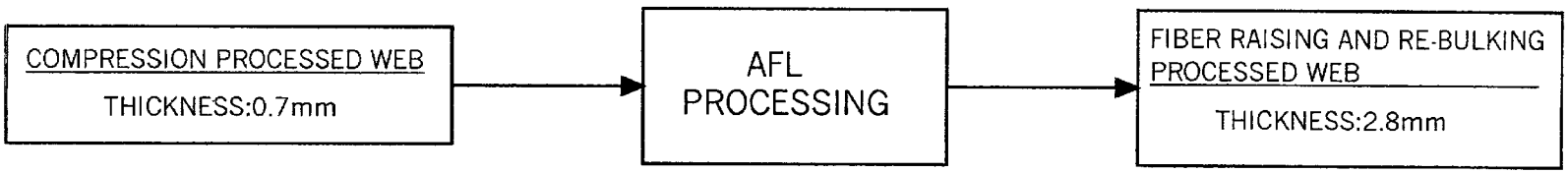
Figure 10A:
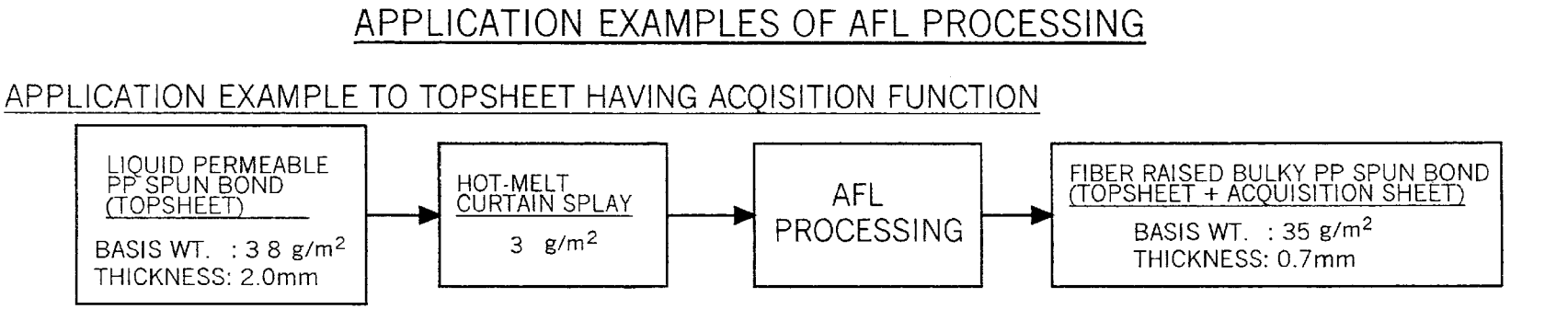
Figure 10B:
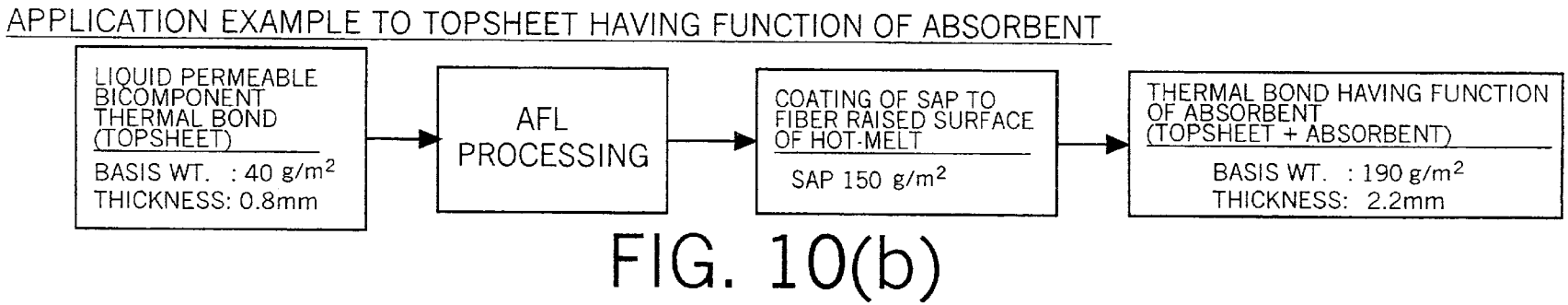
Figure 10C:
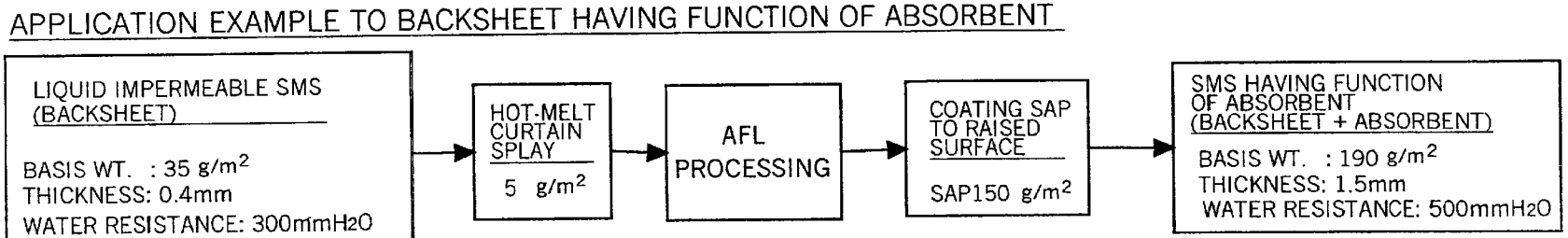
Figure 11A:
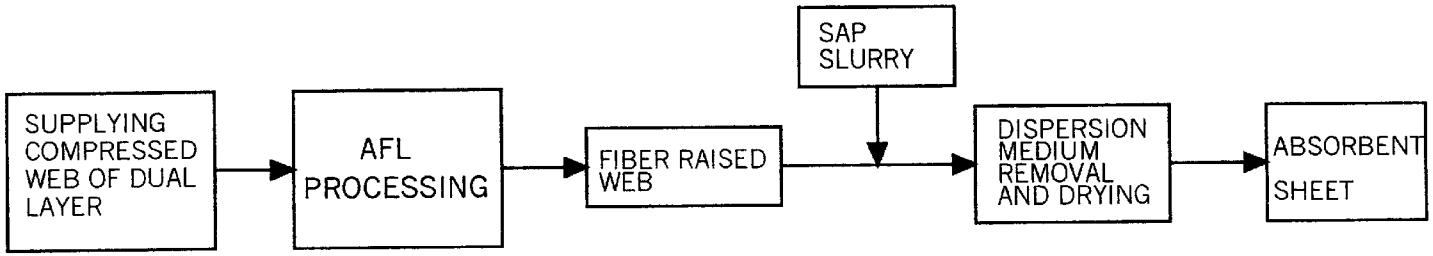
Figure 11B:
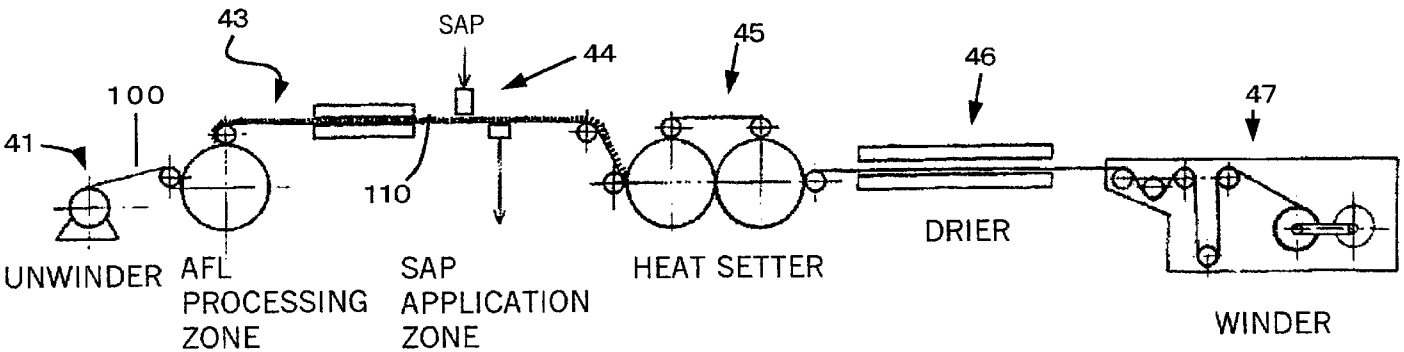

FIG. 1 is a graph showing the measured maintenance of bulkiness of non-woven fabric as has been subject to the AFL processing of the present invention after taken out from storage under compression and slitting after a tension-free condition;

FIG. 2(*a*), FIG. 2(*b*) and FIG. 2(*c*) are diagrams showing process examples of the AFL processing of the present invention, respectively;

FIG. 3 is a schematic side view showing the compression process in the method of the present invention;

FIG. 4(*a*) and FIG. 4(*b*) are flow sheets showing the AFL process in combination with hot melt treatment on the surfaces of respective non-woven webs;

FIG. 5 is a diagram showing the AFL processing system in combination with the hot melt surface treatment;

FIG. 6(*a*) and FIG. 6(*b*) are flow sheets showing examples of the AFL processing of the present invention applied for various kind of sheets;

FIG. 7(*a*) and FIG. 7(*b*) are flow sheets showing the steps of applying the AFL processing of the present invention utilizing compressed non-woven fabric;

FIG. 8(*a*) and FIG. 8(*b*) are flow sheets showing processes of applying other AFL processing utilizing compressed non-woven fabric;

FIG. 9(*a*) is a front elevation of a process roll used in forming compressed lines, and FIG. 9(*b*) shows a procedure during the step of forming compressed lines using the process roll of FIG. 9(*a*), FIG. 10(*a*), FIG. 10(*b*) and FIG. 10(*c*) are flow sheets showing different processes of applying the AFL processing of the present invention; and FIG. 11(*a*) is a flow sheet showing an example of applying the AFL processing in the process of making an absorbent sheet integrated with SAP and non-woven fabric and FIG. 11(*b*) is a diagram showing the system of FIG. 9(*a*).

DETAILED DESCRIPTION OF THE INVENTION

A fundamental concept of the present invention is that a group of fibers on the surface layer of non-woven fabric mainly consisting of fibrous materials are fiber-raised utilizing the properties of its easy-to-heat-melt component to adhere and bond as developed by heating. The processing of non-woven fabric on the basis of this concept is hereinafter referred to as "Adhesion Fiber Lifting (AFL)."

The graph shown in FIG. 1 demonstrates the effects of the AFL processing of the present invention. FIG. 1 shows the measured maintenance of bulkiness when non-woven fabric of 7 denier hollow composite PET (highly resilient web) and non-woven fabric of 1.5 denier regular PET have been subject to the AFL processing of the present invention after taken out from storage under compression and slitting starting from a tension-free condition. The result indicates that even fine denier regular PET non-woven fabric whose bulkiness normally tends to decrease as taken up, slitted and stored under compression realizes even higher bulkiness than in a tension-free condition through undergoing the AFL processing.

Now, the constituent elements of the present invention based on the AFL processing and of the fiber-raised bulky non-woven fabric to be obtained by the present invention are as follows:

Construction of such surface layer of non-woven web as has a property to develop adhesion and bonding as heated;

Adjustment of balance between the degree of adhesion and bonding developed by thermal excitation onto a smooth surface and the property to peel off the smooth surface;

Method and device of thermal excitation;

Method and device of adhering and compressively bonding and peeling off; and

Fiber-raising and fixing of bulkiness.

The above-enumerated items will be explained in detail starting from the surface layer construction of the non-woven web:

Construction of Such Surface Layer of Non-woven Web as Has a Property to Develop Adhesion and Bonding as Heated In order to impart such property as develop adhesion and bonding as heated to the fabric-like non-woven web, the following two approaches are available:

The first approach is to add a component having a property to adhere and bond to the surface of the non-woven web. The other is to beforehand have a fibrous component potential to develop adhesion and bonding exist intrinsically in the surface layer portion of the non-woven web.

Examples of the first approach, adding a component to develop adhesion and bonding, are to treat the surface of the non-woven web with so-called hot melt adhesive, to impart a property to thermally melt onto the surface by adding to the surface an easy-to-heat-melt homo-polymer such as EVA, MA, MMA and PE or particulate, suspension and emulsion of a copolymer of such monomers, and to treat the surface of the non-woven web by means of natural rubber or synthetic rubber latex. The commonest of all is to treat the surface of the non-woven web by means of a hot melt adhesive.

Hot melt adhesives available for this purpose are almost all hot melt adhesives generally known in this field, but preferable hot melt adhesives are those having a property to be little adhesive at the room temperature and to become very adhesive and threading as melted.

As ways to add a hot melt adhesive to the surface layer of the non-woven web are available contact coating, spray coating, coating of filament in a melt blown condition and the like. A hot melt adhesive if added excessively is likely to cause scales on the surface and the surface to be film-like so that a fibrillated or a filament-like hot melt adhesive is preferable since the amount of such hot melt adhesive can be lower to realize the same result.

As such types of non-woven like web as remarkably exhibiting the effects of the hot melt adhesive treatment on the surface, there are available cellulose fiber non-woven fabric such as rayon staple, Liyocell and cotton and synthetic fiber non-woven fabric of a synthetic fiber as represented by PP fiber, acrylic fiber, and PET fiber or its spun bond. Particularly preferable is a web of a so-called multi-layered structure having a cellulose fiber layer and a polyester fiber layer in combination.

The amount of a hot melt adhesive to be added to the surface of such non-woven web is preferably 0.5 $g/m^2$ to 20 $g/m^2$, depending upon the types of the adhesives used, and, more preferably, is in the range of from 1 $g/m^2$ to 5 $g/m^2$. Any hot melt adhesive, if added excessively, may cause such troubles as the hot melt adhesive remaining on the surface of treatment unit.

Next, the second approach, to beforehand have an easy-to-heat-melt fibrous component intrinsically exist in the surface layer portion of the non-woven web, is explained below. Of the methods in this category the easiest-to-employ method is to use such bicomponent fiber as is used as a thermally adhesive fiber as a constituent fiber of the non-woven web.

The bicomponent fiber is fiber having a sheath/core structure consisting of an easy-to-heat-melt polymer component as the sheath component and a relatively thermally stable polymer component as the core component. Typical examples of the sheath/core combinations include PE/PET, PE/PP, a low melting point PET/PET, a low melting point PP/PET and so forth. The amount of such thermally adhesive fiber to be added to exist on the surface of the non-woven web is preferably at least 20% by weight or more and can be 100% by weight, that is to say, the web can be constituted by the thermally adhesive fiber alone.

In order to have a good distribution of the concentration of the thermally adhesive fiber in between the surface layer and the inner or backside layer of the non-woven web, a plurality of carded webs having different blend ratios are prepared and then made into non-woven fabric by heat treatment or entangled and integrated in a high pressure water stream. Alternatively, a spun bond of PE/PET type or PE/PP type and a carded web of chemical or synthetic fiber may be thermally adhered, or such spun bond may be laminated on the carded web by such method as a needle punching, or inversely a carded web of PE/PET type or PE/PP type may be laminated on a spun bond of cellulose fiber or of PET type or PP type.

Adjustment of Balance Between the Degree of Adhesion and Bonding Developed by Thermal Excitation onto a Smooth Surface and the Property to Peel off the Smooth Surface A fundamental concept of the AFL processing of the present invention, as mentioned above, is that the surface of a non-woven web is made to develop adhesiveness or bonding property as heated so that the surface is adhered and compressively bonded to its smooth surface and the surface is peeled off the smooth surface by force to form a fiber-raised structure on the surface. In order to get a desired result as judged from the process of the AFL processing, it is necessary to assure that the following states or conditions are realized on the surface of the web:

(1) Method of preferable heat excitation and state of heat excitation;

(2) State of preferably contacting with the smooth surface;
- Temperature of sheet
- Surface condition of roll
- Degree of adhesion and compressively bonding
- Time of adhesion and compressively bonding (3) Conditions when the peeling off is stably performed
- Angle of peeling off
- Temperature at the time of peeling off
- Condition of the surface of roll If those states or conditions are not satisfied, such troubles as a hot melt adhesive or melted fiber remaining and being deposited on the smooth surface or coiling round the smooth surface may be caused so that the states or conditions are needed to be properly adjusted.

Method and Device of Heat Exciting the Adhesiveness and Bonding on the Surface of the Web by Heating As methods to heat excite the adhesiveness and bonding are available a method of heating in a non-contact way the surface of the non-woven web by applying hot air, infrared rays or dielectric heating, a method of heating the surface of the non-woven web in contact with a heated roll or a heated plate or a method of combining both of them, that is to say, preheating in a non-contact way and then in contact with a heated roll. A method should properly be selected from among them in terms of such conditions as the time of treatment, the treatment temperature and the required time. Depending upon the types of the hot melt adhesives to be applied onto the surface of the non-woven web and the types of the easy-to-heat-melt fibers, generally speaking, in case a hot melt adhesive is used, the heating temperature needs to be approximately 70° C. to 120° C. and in case an easy-to-heat-melt fiber is used, the heating temperature needs to be approximately 140° C. to 200° C. In case a hot melt adhesive and an easy-to-heat-melt fiber are combined, the heating temperature needs to be approximately 120° C. to 180° C.

Method and Device of Maintaining the Uniform Compressively Bonding and Peeling Off from the Smooth Surface In order to form steadily and uniformly fiber-raised surface on the surface of the non-woven web when the surface is peeled off from the smooth surface, it is necessary to bond the heated surface layer of the non-woven web adhesively to the smooth surface uniformly and in order to have such uniform bonding it is necessary to apply pressure uniformly to the uniform surface layer. In general, a smooth plate or a smooth roll in the shape of a belt is moved at a speed nearly synchronous with that of the running sheet.

The surface of the smooth plate may have minute concaves and convexes on the surface like fine mesh or pear skin, but in general, such smooth plate as has the degree of smoothness as is finished with a buff is used.

The ease of peeling off from being adhered and bonded goes against the ease of forming a fiber-raised surface. A typical relationship is shown in Table 1 below:

TABLE 1

| Material of roll | Degree of heat-adhesion | Ease of peeling off | Formation of adhering substance on surface of roll | Degree of fiber-raising |
|---|---|---|---|---|
| Teflon coated | Low | Easy | Little | Low |
| Chrome plated | High | Difficult | Much | High |

Accordingly, in case the pressure of compressively adhering is low and the temperature is high, the chrome plated roll can be used, but at relatively high temperature and pressure, a roll whose surface is coated with such easy-to-peel material as fluorocarbon resin or silicone resin is preferably used. A roll having chrome plated layer portion and Teflon coated layer portion in combination on the surface is sometimes used.

As described above, a smooth roll is used in general, but a roll may be provided with grids in part or a scraper on the surface in order to have partial fiber-raising or prevent fibrous material or hot melt adhesive from being adhered on the surface of the roll or to aid in peeling off.

Fixing of Fiber-raised Bulky State

A web with its surface peeled off as heated to be fiber-raised is cooled down naturally or by force to fix the fiber-raised bulky state.

In general, an indirect cooling is employed wherein air or cooled air is blown onto the heated surface. Or in some special cases such as a case where the surface is after-treated in a wet condition, a method is employed of spraying water or chilled water by means of a sprayer.

It is possible to cool down in contact by means of a chilled roll, but in this case cooling is preferably done with the backside in contact with the roll lest the fiber-raised surface should return to its original non-raised state as the fiber-raised surface is compressed as cooled down.

Basic Process of the AFL Processing and its Embodiment

A basic process of the AFL processing consists of unit processes of heating the surface layer portion of non-woven web as fed, compressively adhering it to a smooth roll, peeling it off the roll to form a fiber-raised structure and stabilizing the fiber-raised structure by cooling down.

An example of the basic process is shown in FIGS. 2(*a*) to 2(*c*).

In a method shown in FIG. 2(*a*) in a heating zone 11 a web 10 with its surface heated sufficiently is guided onto a cooling roll 12 of a smooth surface at room temperature or chilled and compressively adhered by means of tension operating between guide rolls 13 and 14. After the web 10 has been kept as bonded on the surface of the roll for a prescribed period of time, the web 10 is peeled off the surface of the roll when fiber-raising is caused and a bulky non-woven fabric 100 is obtained. In this case, cooling after peeling is unnecessary.

FIG. 2(*b*) shows a combination of preheating of the surface of web 10 in a preheating zone 11 a and heating by means of a heated roll 15 having a smooth peripheral surface. The non-woven web 10 whose surface has been preheated is heated as compressively adhered on the smooth surface of the heated roll 15. The web 10 after it has been bonded onto the surface of the roll 15 is peeled off the surface of the roll 15 in the peeling zone and with a chilled roll 14 a placed onto the backside the fiber-raised condition is stabilized.

FIG. 2(*c*) shows a process of heating the surface of the web by means of a heated roll 15 alone without preheating applied. The cooling is performed in a cooling zone 16 provided in the rear side of a guide roll 14. In this case, the temperature of the heated roll 15 is relatively high and its diameter may need to be made larger than in the previous process.

The processes shown in FIG. 2(*a*) and FIG. 2(*b*) are suitable for treating non-woven web having easy-to-heat-melt fibers on the surface layer. The process shown in FIG. 2(*c*) is suitable for treating the surface with a hot melt adhesive at relatively low temperature.

In the processes shown in FIG. 2(*a*), FIG. 2(*b*) and FIG. 2(*c*), respectively, it is preferable to use one or more rolls 17 as shown in FIG. 3 for maintaining a good compressive adhering between the web 10 and the smooth roll 12. In addition, in order to prevent a molten part of web 10 from adhering and depositing on the surface of the roll 12, a scraper 18 may be preferably provided above the surface immediately after the guide roll 14. Further, in order to achieve more tight compressively adhering condition, the running speed V2 of the web 10 coming out of the contact region between the web 10 and the roll 11 should be higher than the running speed V1 of the web 10 going into the contact region.

Embodiment of the AFL Processing in Combination with a Hot melt Treatment on the Surface of a Non-woven Web As described above, a complete AFL processing system is assembled by combining a basic process of the AFL processing with a process of thermally activating the surface of a non-woven web.

FIGS. 4(*a*) and 4(*b*) show flow sheets of examples of the AFL process in combination with a hot melt treatment of the surface of a non-woven web.

FIG. 4(*a*) shows an example of applying the AFL process to an SMS non-woven fabric. The SMS is a composite of three components of a spun bond (SB), a melt blown (MB) and a spun bond (SB). According to a test, in a combination of 10 g/m$^2$ of SB (1), 5 g/m$^2$ of MB and 13 g/m$^2$ of SM (2), a hot melt adhesive of EVA type is sprayed as fibrillated onto the side of 13 g/m$^2$of SB (2) and then the AFL processing is performed in a process as shown in FIG. 2(*a*) with the result that the surface became fiber-raised and a non-woven fabric made bulky having an apparently doubled thickness is obtained. It is to be noted that the thickness is measured by means of a thickness gauge (3 g/cm$^2$ load) of Daiei Chemical Precision Instruments Co., Ltd.

FIG. 4(*b*) shows an example of applying the AFL process to a two-layered spun lace. The spun lace (SL) is made into a non-woven fabric by means of a so-called spun lace method where a carded web of polyester fiber of 4 d×54 mm (15 g/m$^2$) is folded on a carded web of viscose rayon of 1.5d×35 mm (15 g/m$^2$) and given a high pressure water stream from the rayon side.

A hot melt is sprayed onto the polyester fiber side of the non-woven fabric and the AFL processing is applied as in the process shown in FIG. 2(*c*) with the result that the surface became fiber-raised and a significantly bulky spun lace with fiber raised surface is obtained.

FIG. 5 shows an example of the construction of the whole of the AFL processing combining the bulking of the present invention with a hot melt surface treatment to be performed in advance to the bulking treatment. A non-woven web 20 unwound from a roll 21 is made to pass between a pair of guide rolls 22 and 23 and pass under a hot melt spray equipment 24 and then guided to a bulking process as shown in FIG. 2(*a*).

Embodiment of the AFL Processing System Utilizing Easy-to-heat-melt Fibers

As a method to thermally activate the surface of a non-woven fabric, a process of applying the AFL processing to a substrate where an easy-to-heat-melt fiber is distributed in the surface layer of a non-woven web is explained below.

FIG. 6(*a*) and FIG. 6(*b*) show examples of applying the bulking treatment of the present invention to non-woven fabric of a spun bond (SB) and a thermal bond from a carded web using polyethylene (PE)/polyester (PET) fiber with the polyethylene as the sheath as a sheath/core bicomponent fiber.

More particularly, FIG. 6(*a*) shows an example of utilizing SB (a product of Unitika Ltd. sold under the trademark "Elbes"). In this example, a bulky SB with fiber-raised surface having an apparently doubled thickness is obtained by the AFL processing in a process shown in FIG. 2(*b*).

FIG. 6(*b*) shows another example of applying the present invention to a thermal bond non-woven fabric made into a non-woven fabric by a thermal spot bonding of a carded web made of a bicomponent fiber, which shows that an originally relatively bulky web of 0.6 mm thickness is substantially increased in thickness.

Manufacturing of Compression Pressed Non-woven Fabric and an Embodiment of Applying the AFL Processing to the Non-woven Fabric The thermal activation process and the system in combination with the AFL processing have been explained so far. The purposes of the AFL processing are to save the cost of handling raw material non-woven fabric by making it as thin and compact as possible and to develop bulkiness as much as possible when it is processed or used. To achieve such purposes, a non-woven web is taken up in a condition as compressed as possible with its thermoplastic property utilized in the process of manufacturing the non-woven fabric and made bulky with its thermoplastic property utilized with the AFL process incorporated in the processing to realize the bulkiness so that a substantial saving in material handling cost can be achieved.

FIG. 7(*a*), FIG. 7(*b*) and FIG. 8(*a*), FIG. 8(*b*) show each a process of compression pressing a non-woven fabric and an embodiment of applying the AFL processing utilizing the compression pressed non-woven fabric. FIG. 7 shows an example of utilizing a hot melt. FIG. 8(*a*) and FIG. 8(*b*) show examples of utilizing a bicomponent fiber.

More particularly, FIG. 7(*a*) shows a flow sheet of a process of compression pressing for a two-layered spun lace non-woven fabric where the two-layered carded web is entangled in a high pressure water stream and then dried to manufacture a spun lace non-woven fabric. The non-woven fabric as it is manufactured having a bulkiness of approximately 2.0 mm thick is compressed to approximately 0.8 mm thick after sprayed with a hot melt and compressed by means of a chilled roll so that the compressed condition is stabilized by the hot melt. If a non-woven fabric of approximately 2.0 mm is wound up, the size of the resultant roll is 1000 mm long and 800 mm diameter, but as it is compressed, the size can be reduced to 3000 mm long and 900 mm diameter.

FIG. 7(*b*) shows that, if the compressed non-woven fabric is subjected to an AFL processing in a separate line, the binding by the hot melt is released to have the bulkiness recovered and at the same time, as the effects of the AFL processing added, the bulkiness can get more than three times.

Also, FIG. 8(*a*) shows a process of applying the same as mentioned above on a two-layered air-through non-woven fabric consisting of a bicomponent fiber. The thickness of a non-woven fabric having an easy-to-heat-melt fiber as bound by an air-through method is approximately 1.8 mm, while if it is compression pressed by a heat press before wound up the thickness gets reduced down to approximately 0.7 mm. If the compression pressed web obtained in FIG. 8(*b*) is subjected to an AFL processing in a separate line, a bulked web with fiber-raised surface of 2.8 mm thick could be obtained which is made approximately four times bulkier by virtue of the effects of the AFL processing as the original bulkiness is recovered by heat treatment.

In the bulky non-woven fabric obtained by the present invention, the physical properties such as resilience, elongation and tensile strength are dependent to a great extent upon the intrinsic properties originally possessed by a non-woven fabric substrate used. If any change is desired of any such original properties, some or other treatment can be applied on the bulked non-woven fabric.

FIG. 9(*a*) shows an example of processing roll 30 to be used for such purpose. The processing roll 30 has on its periphery a plurality of rings 31 arranged at some appropriate intervals in the axis direction. The processing roll 30 is disposed facing a roll 32 having a flat periphery surface as shown in FIG. 9(*b*) and rotated in the opposite direction with each other as heated at some appropriate temperature. A bulky non-woven fabric 100 to be processed by the roll 30 is made to pass through a nip between the processing roll 30 and the roll 32 as the bulked surface is kept in contact with the processing roll 30. In this process, the bulked non-woven fabric 100 is compressed as partially melted by the heated ring of the processing roll 30 to form compressed lines 110.

At these compressed lines 110, the construction of the bulked non-woven fabric becomes tight and as a result its tensile strength in the direction parallel to the compressed line is improved to a great extent. The pattern of the formed compressed line is not restricted to a parallel line shown in FIG. 9(*b*).

Examples of Applying the AFL Processing to Various Materials

The above-described processes of the AFL processing can be incorporated as unit processes into systems of utilizing various non-woven fabrics. FIG. 10(*a*) to FIG. 10(*c*) show a typical examples thereof.

FIG. 10(*a*) is an example of incorporating the AFL processing of the present invention into the processes of manufacturing disposable baby and incontinent diapers. That is to say, a topsheet of relatively thick SB is sprayed with a hot melt as being fed and is made to pass an AFL unit to nearly treble the bulkiness caused by fiber-raising. With the fiber-raised portion disposed on the absorbent body and the smooth surface disposed on the skin of a wearer, the topsheet can be used without another non-woven fabric used as an acquisition layer, that is to say, the topsheet has dual functions. Hence, it can serve to save materials and to reduce the cost to a great extent.

FIG. 10(*b*) shows another example of imparting an absorbent function to a non-woven fabric possessing properties suitable as a topsheet. A relatively heavy and bulky thermal bond is processed by the AFL processing with the result that a significantly bulkier structure may be obtained caused by fiber-raising. When a highly absorbent polymer (SAP) made in slurry is used to coat the fiber-raised surface, SAP particles are taken inside the raised fibers so that a large amount of SAP can be held within the web stably. With the smooth surface of thus obtained composite disposed in contact with the body of a wearer with the absorbent body surface disposed at the backsheet side, it can be used in an absorbent article as an integral structure of the topsheet and the absorbent body.

FIG. 10(*c*) shows a further example of applying the same concept as described above to a backsheet. As a substrate a relatively heavy SMS which is liquid impervious and water resistant although air permeable is prepared. If hot melt is sprayed to the SMS to make the sprayed surface bulky by means of the AFL processing and the resultant bulkiness is almost trebled as caused by fiber-raising. When SAP in slurry is applied to coat the bulked surface, SAP particles are taken inside the fiber-raised structure and a composite body is obtained having both the functions of a backsheet and an absorbent body. At the same time, this composite body has a greatly improved water resistance by virtue of the effects of the hot melt and of the SAP coating. By utilizing this composite body in the manufacturing of absorbent articles, a system of manufacturing an absorbent body wherein the process is significantly simplified can be constructed.

A Process of Manufacturing an Absorbent Sheet Where the AFL Processing is Incorporated with a Compressively Pressed Non-woven Fabric Used as an Absorbent Substrate FIG. 11(*a*) shows a flow sheet of applying the concept of the AFL processing in a process of manufacturing an absorbent sheet wherein SAP and a non-woven fabric are integrated, and FIG. 11(*b*) shows a schematic diagram of devices for carrying out the process.

A thinly and compactly compressively pressed web obtained in a process similar to the process shown in FIG. 7(*a*) is fed as a substrate for manufacturing an absorbent sheet. By applying the AFL processing to the compressively compressed web, a web can be obtained with fiber-raised surface made of approximately trebled bulkiness. SAP in slurry is applied to coat the fiber-raised surface continuously and the solvent contained in the SAP is removed and dried. Thus, a novel absorbent sheet wherein SAP and the non-woven fabric are integrated could be manufactured. The apparatus for performing this process, as shown in FIG. 11(*b*), consist of an unwinder 41, an AFL processing zone 42, a cooling zone 43, SAP application zone 44, a heat setter 45, a drier 46 and a winder 47. A non-woven fabric 100 wound out of the unwinder 41 is subjected to an AFL processing in the AFL processing zone of any construction describe in the foregoing examples resulting in the fiber-raised bulky non-woven fabric 110. SAP is applied to coat the fiber-raised surface of the bulky non-woven fabric 110 in the SAP application zone 44. Then, the bulky non-woven fabric with its surface layer coated with SAP is compressed as heated in the heat setter 45 and thus SAP particles are held together by the raised fibers. After dried in the drier 46, the coated fabric is wound up by the winder 47 in the shape of a roll. The thus obtained product is in the shape of a sheet wherein SAP particles are contained as held by the raised fibers of the non-woven substrate and as such sheet absorbent body can be used in a wide variety of applications.

What is claimed is:

1. A method of bulking a non-woven fabric comprising the steps of:

adhering a non-woven web with its surface layer portion containing an easy-to-heat-melt component showing a property to be adhesive when heated to a smooth surface heated at a temperature for the easy-to-heat-melt component to show a property to be adhesive with said surface layer portion to thereby adhere to the smooth surface, said easy-to-heat-melt component existent in said surface layer portion containing 20% to 100% by weight of bicomponent fibers having a property to become adhesive when heated; and peeling the non-woven web off said smooth surface so that the fibers of said non-woven web are raised to thereby form a fiber-raised bulky structure on a surface of said non-woven fabric.

2. The method of claim 1 wherein said adhering step includes a step of compressively adhering said non-woven web toward said smooth surface as heated.

3. The method of claim 2 wherein said heated smooth surface has a cylindrical shape and said adhering step is performed by at least one press roller for compressively adhering said non-woven web onto said cylindrical smooth surface.

4. The method of claim 1 wherein, prior to said adhering step, a preheating step is further provided for preheating said non-woven web to be introduced into said adhering step by being made to pass through a hot air zone.

5. The,method of claim 1 wherein a post treatment is further provided for cooling down said non-woven web to stabilize the fiber-raised structure.

6. The method of claim 1 wherein a pressing step is further provided for partially pressing said non-woven web to an extent not significantly affecting the fiber-raised structure by pressing a heated roll provided with a projection onto the surface having an already fiber-raised structure of said non-woven web.

7. A method of bulking a non-woven fabric comprising the steps of:

obtaining a compressed non-woven web by making a non-woven web in a dry state containing easy-to-heat-melt bicomponent fibers in its surface layer portion pass through a heated compressing roll to reduce the thickness of the non-woven web;

contacting said resultant compressed non-woven web with a surface of a roll heated at at least a fluidizing temperature of said easy-to-heat-melt component, adhering the non-woven web onto the roll and peeling the non-woven web off the roll so as to raise the fibers of the non-woven web; and stabilizing a fiber-raised bulky structure by cooling down a fiber-raised portion of said compressed non-woven web.

8. The method of claim 7 wherein said non-woven web is a spun lace web wherein a surface layer web mainly consisting of polyethylene terephthalate fiber is laid on a backside surface layer mainly consisting of cellulose fiber in two-layered carded web and the carded web is entangled in an integrated way in a high pressure water stream and then dried.

9. The method of claim 7 wherein said non-woven web is prepared by entangling in a high pressure water stream and combining a mixed carded web of a polyethylene/polyethylene terephthalate bicomponent fiber and a cellulose fiber with a spun bond of polyethylene terephthalate as a substrate.

10. The method of claim 7 wherein said non-woven web is prepared by entangling in a high pressure water stream and combining a mixed carded web of a polyethylene/polyethylene terephthalate bicomponent fiber and a polyethylene terephthalate fiber with a cellulose non-woven fabric as a substrate.

11. The method of claim 7 wherein said non-woven web is a three-layered composite web of a two-layered spun bond web mainly composed of polyethylene terephthalate or polypropylene fiber and a melt blown web disposed between two layers of the spun bond web.

12. The method of claim 11 wherein said melt blown web is made of a plurality of layers.

13. The method of claim 11 wherein the two layers of the spun bond web constituting said composite web have different deniers, respectively, with denier (d1) of the web disposed on a surface side being coarser than denier (d2) of the web disposed on a backside, a relation between the deniers (d2) and (d1) being $d2/d1 \geqq 1.5$.

14. The method of claim 11 wherein the two layers of the spun bond web constituting said composite web have different apparent specific gravities, respectively, with apparent specific gravity (SG1) of the layer disposed on a surface side being higher than apparent specific gravity (SG2) of the web disposed on a backside, a relation between the bulk specific gravities (SG1) and (SG2) being $SG2/SG1 \geqq 1.2$.

15. The method of claim 7 wherein said non-woven web is a spun bond mainly constituted by a bicomponent fiber having a property to be easy-to-heat-melt.

16. A fiber-raised bulk non-woven fabric comprising a non-woven web with a surface layer portion and an easy-to-heat-melt component deposited on the surface layer portion and having a property to become adhesive when heated, said easy-to-heat-melt component containing bicomponent fibers consisting of an easy-to-heat-melt composition having a property to become adhesive when it softens and melts and of a high polymer of relatively thermal stability, said easy-to-heat-melt composition being adhered to a smooth surface heated at a temperature at which said easy-to-heat-melt composition exhibits a property to become adhesive with said surface layer portion in contact with said smooth surface, and then peeled off said smooth surface to generate a fiber-raised bulky state whereby a fiber-raised bulky structure is formed on the surface of said non-woven web.

17. The fiber-raised bulky non-woven fabric of claim 16 wherein a content of said bicomponent fibers is 20% to 100% by weight of a total weight of said non-woven web.

18. The fiber-raised bulky non-woven fabric of claim 16 wherein said bicomponent fibers have a sheath/core structure with a low melting point component as a sheath and a relatively thermally stable component as a core.

* * * * *